United States Patent [19]

Müller

[11] 4,112,590

[45] Sep. 12, 1978

[54] COMBINED DRUM WASHER AND DRYING ARRANGEMENT

[75] Inventor: Franz Müller, Bad Honnef, Fed. Rep. of Germany

[73] Assignee: August Lepper, Maschinen- und Apparatebau GmbH, Bad Honnef, Fed. Rep. of Germany

[21] Appl. No.: 731,818

[22] Filed: Oct. 12, 1976

Related U.S. Application Data

[63] Continuation-in-part of Ser. No. 697,739, Jun. 18, 1976.

[30] Foreign Application Priority Data

Oct. 13, 1975 [DE] Fed. Rep. of Germany ..... 2545795
Jul. 2, 1975 [DE] Fed. Rep. of Germany ..... 2529577

[51] Int. Cl.[2] ..... F26B 11/04
[52] U.S. Cl. ..... 34/75; 34/77; 34/133
[58] Field of Search ..... 34/73, 75, 77, 133; 68/18 C, 20

[56] References Cited

U.S. PATENT DOCUMENTS

| | | | |
|---|---|---|---|
| 2,717,456 | 9/1955 | Smith | 34/75 |
| 2,720,037 | 10/1955 | Erickson | 34/75 |
| 2,743,533 | 5/1956 | Smith | 34/75 |
| 2,833,056 | 5/1958 | Smith | 34/75 |
| 2,856,699 | 10/1958 | Frey | 34/75 |
| 3,022,581 | 2/1962 | Smith | 34/75 |
| 3,132,005 | 5/1964 | McMillan | 34/75 |
| 3,266,166 | 8/1966 | Fuhring | 34/75 |
| 3,805,404 | 4/1974 | Gould | 34/75 |
| 3,816,070 | 6/1974 | Candor et al. | 34/133 |

*Primary Examiner*—John J. Camby
*Assistant Examiner*—Larry I. Schwartz
*Attorney, Agent, or Firm*—Cushman, Darby & Cushman

[57] ABSTRACT

An improved combination washer-dryer comprised of an inner and outer container which are spaced apart so as to form a condensation chamber therebetween. A cooling medium and moist air withdrawn from the inner drying container are simultaneously forced through that chamber which cools the air and causes moisture contained therein to be condensed and thus separatable from the air. Additional condensation and water separators can be employed to further treat the circulating air prior to that air being reheated and returned to the inner drying container.

30 Claims, 8 Drawing Figures

COMBINED DRUM WASHER AND DRYING ARRANGEMENT

This is a continuation-in-part of application Serial No. 697,739 filed June 18, 1976.

This invention relates to a combined drum washer and dryer with air circulation preferably in a closed circuit, in which the moisture-laden air can be circulated via the washing drum, by way of a condenser which has been charged with water from the outside, a ventilator and a radiator for heating of the dry air.

Combined drum washers and dryers have been known in the prior art. U.S. Pat. No. 3,387,385 shows an arrangement where moisture-laden air is drawn off from an inside drum and cooled by the addition of cold water so as to condense water vapor. The separated, dryer air is again returned by way of a suction-pressure blower into the liquor tank, whereby it is heated upon introduction into the liquor tank with the help of a radiator.

In this known drying arrangement, the moisture-laden air is drawn off over a relatively small surface area of the inside drum so that the volume of air circulated per unit of time is relatively small. One major disadvantage of such prior art combined washing and drying arrangements is that the period of time required for drying is very great and usually is in excess of 2 hours for a standard wash load. This disadvantage results, on the one hand, as the result of the circulation path for the recirculated air and, on the other hand, as a result of the relatively low degree of effectiveness of the condensation arrangement.

Another known combined drum washer and dryer arrangement is shown in Swiss Pat. No. 280,805. In this arrangement the moisture-laden air drawn off in the central area of the drying drum is directed into a rear channel so it can be recirculated. Located in that rear channel is a plate condenser through which cooling water is pumped. The air being recirculated has less moisture as a result of its contact with the condensation apparatus and thereafter the circulating air is guided across heating surfaces and heated thereby. The heated air is then reintroduced into the drum, with the help of a suction-pressure blower via a perforated part along the outside periphery of the rear wall of the inside drum, whereby the air is again charged with moisture and the circulation cycle starts all over again.

The feeding in of the heated air through either the outside perforation or else the rim perforation on the rear side of the drum is very unfavorable, especially during the initial drying process since the relatively wet wash is packed relatively thickly on the outside edge of the drum and the fed-in, as well as warmed-up recirculated air, cannot be charged optimally with moisture. During the drying process the laundry is initially cooled and as a consequence the temperature of the recirculated air is kept at a relatively low level during the main part of the drying time. Thus, because of the disadvantages of this particular device the effective drying time needed for one load of laundry is also disproportionately long.

The feeding of recirculated air by way of a radiator located in a bulge in the outside container, whereby recirculated air is introduced by way of perforations on the inside drum and corresponding perforated ribs projecting into the inside drum for a better intermixing with the laundry has also been known. U.S. Pat. No. 2,314,748 describes a device suitable only for drying which likewise operates with recirculated air but wherein a portion of the moisture-laden air is discharged to the outside and is replaced by fresh and it is hoped somewhat dryer ambient air. While the perforted ribs on the inside drum improve the intermixing of heated air and wet laundry, the recirculation path is not closed and the fresh air may not be very much dryer than air remaining in the circulation path especially if the intake is near the machine.

In order to improve the intermixing of the recirculated air with wet laundry, it is also known to conduct air over a heater positioned above the liquor container through a suitable opening provided therein. As a result, the heated recirculated air is directed toward the laundry from the inside of the inner container or drum thereby enhancing the intermixing with the wet wash and also improving the amount of moisture picked up in the air emerging via the perforations in the outside surface of the inner container or drum.

Further, U.S. Pat. No. 2,718,711 discloses a dryer in which fresh air is fed from the outside via a radiator, which is disposed in a relatively large surfaced bulge in the outside drum and is provided with a radiation plate which reflects the produced heat radiation in the direction of the inside container or drum.

The disadvantages of known combined drum washers and dryers primarily relate to very poor evaporation performance in the order of magnitude of about 8 to 10 $cm^3$/minute so that consequently very long drying times result, whereby normal drying times are about 150 minutes per 2.5 kg of laundry. Of course, this relatively poor drying performance consumes great amounts of energy and cooling water. In the case of dryers-only which do not operate with recirculated air, but which discharge the moisture-laden air into the atmosphere, more favorable drying times can indeed be achieved with a considerable expenditure of energy. However, because of their construction such dryers cannot be combined with drum washers and still maintain their drying performance, as the environmental influence through heat and moisture in the flow of used air would be undesirable.

The present invention has as its primary object the creating of a combined drum washer and drying arrangement, in which the operating time for drying can be considerably decreased to that of a drying-only arrangement and wherein the consumption of cooling water and power consumed during drying can be decreased considerably by utilization of the heat from the process. Thus, through use of the present invention the finishing costs must only be slightly influenced by the insertion of the drying arrangement. Another object of the present invention is to reduce the drying time to about 70%, the consumption of cooling water to about 75% and the power consumption for the heating to about 10% vis-a-vis hitherto known combined drum washer and drying arrangements for normal laundry loads related to about 2 kg of dry laundry.

Starting out from the initially mentioned combined drum washer and drying arrangement, these and other objectives are achieved, according to the invention, by a combination of the following individual measures:

(a) The circulating air can be drawn off preferably in the lower area of the rear side of the liquor container;

(b) The cooling water can be fed in at about half the height, preferably on both sides of the liquor tank, in such a way that a film of water develops on the inside of the liquor tank as a result of the circulating air, guided downwards during drawing-off, and that moisture is separated from the circulating air by condensation;

(c) A radiator with a radiation plate pointed to the drum is disposed in the upper part of the liquor tank, distributed over a sector, with which radiation plate the inside drum is heated directly by radiation;

(d) The air, cooled by condensation, is again blown into the drum by means of a suction-pressure blower system from above, whereby the circulating air is guided via the radiation plate for the purpose of heating.

a combined washer and drying arrangement designed according to these characteristics produces a considerable reduction in the time required for drying. This is the result of the favorable combination of direct heating of the inside drum by way of the outside surface of the drum cylinder, whereby the wash and the atmosphere surrounding it can be maintained at a temperature in which the fed-in circulating air is charged with moisture to full saturation. Also the forced circulation produced between the two tanks along with the preferred drawing-off of the withdrawn air from the lower area of the liquor tank helps to assure that the cooling water supplied for condensation purposes will flow as a substantially continuous film of water on a large surfaced part of the inside of the liquor tank. Thus, the circulating air withdrawn from the inside drum over or across that substantially continuous film of cooling water will be cooled and a considerable portion of the moisture contained therein will be condensed and separated from the air and thus able to be drained away with the cooling water. At the same time, the majority of slubs or lint particles entrained in the air withdrawn from the inside drum, are seized or collected by the film of water and discharged by way of the draining system, so that they are kept away from the suction-pressure blower system and from the heater. The circulation air is reintroduced over a large surfacr via the outside of the heater, and in particular, heat will be radiated into the inside drum, so that the temperature therein will be raised to a temperature which is most appropriate for allowing the air therein to absorb moisture.

In order to shorten the drying process still further, provision has been made for employing an additional condensation and water separation arrangement over which the circulating air is conducted after being drawn off from the liquor tank. This arrangement is particularly effective whenever the circulation air carried away from the liquor tank is used first in a heat exchanger for heating the circulating air. In this heat exchanger, a set of interior and exterior tubing are preferably arranged coaxially, at least in stretches, whereby the inside line conducts the circulating air from the liquor tank to the additional condensation and water separation arrangement and the outside line conducts the circulating air from the condensation and water separation arrangement to the inner drum or drying container.

With the help of this design, it will be possible to reduce drying time since heat obtained during processing in the heat exchanger aids in heating the circulating air being returned into the inside drum. By utilizing heat generated during the drying process that drying process is made more economical.

A further development of the invention provides, furthermore, that the conduction of the air across the radiation plate be developed such that the circulating air be conducted in a flat channel extending essentially across the entire radiation or heating plate. In order to avoid any loss of processing heat, provision has been made, furthermore, for employing a suitable layer of insulation on the exposed portions of the channel.

In order to reduce the drying time still further, an additional heater can be employed in the circulating air conduit downstream from the suction-pressure blower and before the primary heater. Thus, circulating air guided across the primary heating plate will have been preheated so that less energy is needed to heat the air to the desired predetermined temperature so that heating the inside drum by direct radiation will be ensured.

Provision has been made preferably in a special development for the heat exchangers, made in stretches as coaxial conduits, to consist of a rigid inside pipe with the line lying outside being comprised of a hose which has been slipped onto the rigid inside pipe.

It will also be of advantage to arrange the heater in a pressed-out portion in the upper part of the liquor tank, whereby the pressed-out surface will constitute the radiation or heating plate. As a result of such construction, the production costs for the combined drum washer and dryer can be reduced to the point where the combined arrangement can be produced with a very small additional cost as compared to the drum type washing-only machines.

A still further object is to achieve an optimum exchange between the circulating air being returned to the inside drum and the moisture-laden air within that inside drum while using the smallest quantity of circulating air. To achieve that exchange it is important to optimally charge incoming air with moisture being released from the wet laundry, that the incoming air supply the proper amount of heat to the laundry and if the air is to be recycled that substantially complete condensing take place within the condenser. At the same time, however, care should be taken that the circulation of air takes place with as little noticeable noise as possible.

An additional development is the incorporation of specially designed nozzle structure for distributing the incoming air into the inside drum directly above the laundry being dried in a fanlike manner. By blowing the incoming air through this nozzle, the air blown directly above the laundry will experience a considerable amount of turbulence and will be more intensively charged with moisture. Preferably, the nozzle can be a flattened or spread out structure provided with a plurality of perforations comprised of slots or holes and having an outlet cross section running over a circular sector.

By employing such a nozzle structure which develops the fanlike distribution of air, the circulating air can be substantially evenly distributed over the entire upper surface of the laundry being treated such that the cross section of the inside drum, determined by the upper surface of the laundry, can be swept without noticeable dead areas or angles. Also, by inclining the direction of airflow slightly downward in the exit area of the nozzle, the circulating air will be given even better turbulence across the upper surface of the laundry.

In another development, the circulating air withdrawal conduit can be formed from the overflow pipe which can have its inlet end positioned adjacent the drain from the liquor tank so as to suck off circulating air up to an area free of water thereby further enlarging the surface area available for condensation. The exit of the overflow pipe must usually be positioned just below the height of the flush-in for the water, usually about 10 cm., so that only a small additional section of pipe would be required to connect the overflow pipe to the suction-blower.

The overflow pipe can also be provided at its outlet end with a valve which will allow the pipe to act as an overflow pipe but which will automatically close when suction is placed on the pipe by the suction-blower when air circulation is initiated. In this manner the combined washer-dryer can employ one conduit as both the overflow pipe and air return conduit.

Other advantages and characteristics of the preferred embodiments of the present invention will also result from the following description taken together with the drawings in which.

Figure 1:
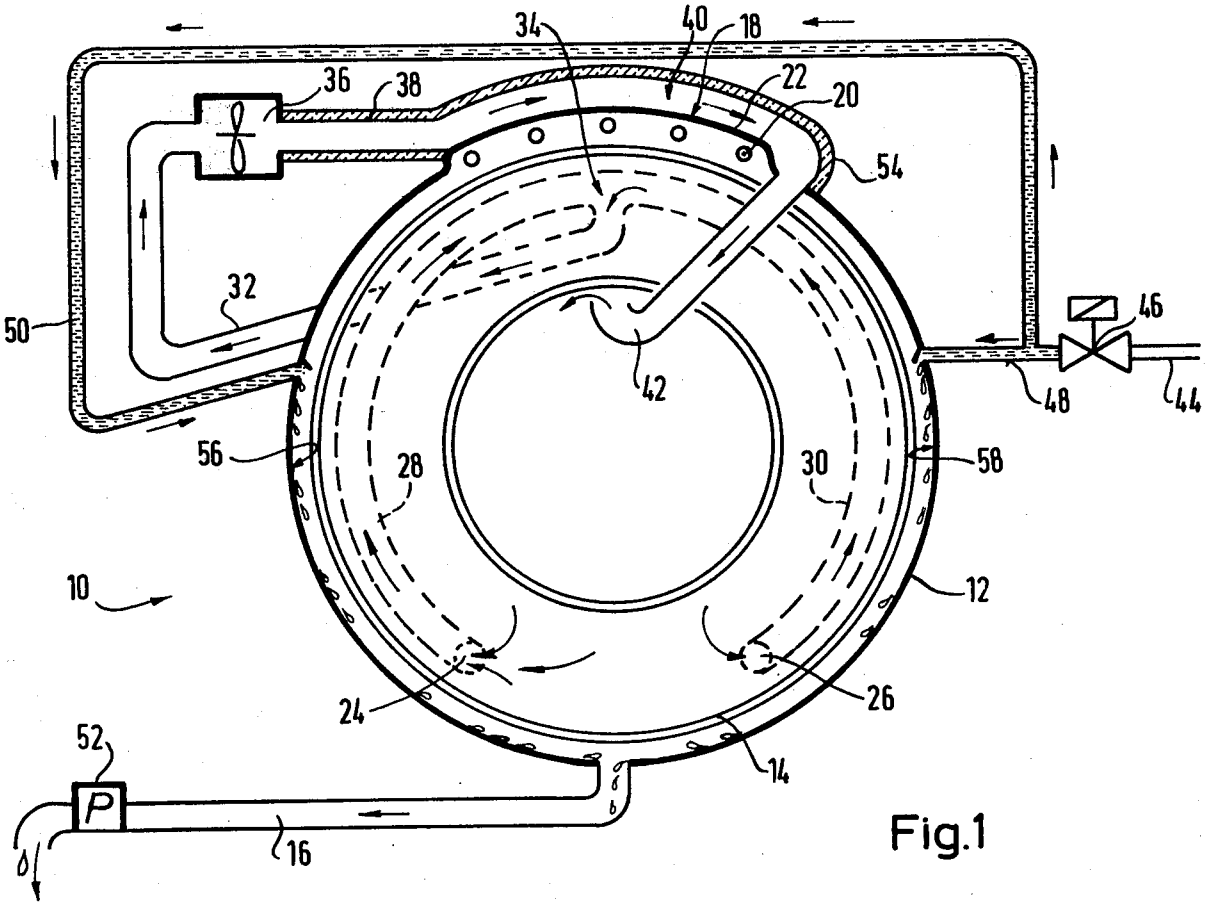
FIG. 1 is a schematic fragmentary presentation of a drum washer and drying arrangement with a closed circulating air system for the drying process, whereby moisture is effectively removed from the moist air withdrawn from the inner drum and lost heat from the heater is used for heating the circulating air in which the front outer housing and charging door has been omitted for clarity.

According to FIG. 1, the drum washer and drying arrangement generally referred to at 10 comprises a drum-shaped liquor tank 12, in which a perforated inside drum 14 is rotatably mounted so as to be disposed coaxially or eccentrically within and spaced away from liquor tank 12 so as to serve as a washing drum. On the underside of the liquor tank 12 is a draining system 16, by way of which the washing liquor during the washing process and the condensate, as well as the cooling water, can be discharged. The liquor tank 12, on its top side, has been provided with a bulge 18, in which a radiator 20 is installed, whereby the pressed-out surface of the liquor tank 12 serves as a radiation plate 22. Additionally, heat radiated in the direction of the inside drum is increased by radiation plate 22. The sheet metal of the inside drum 14 transmits the absorbed heat energy and delivers it to the laundry in drum 14. On the rear side of the liquor tank 12, apertures 24 and 26 are provided and run off pipes 28 and 30 are connected thereto by any suitable means such as welding or threaded connections (not shown). Pipes 28 and 30 are each suitably connected to a conduit 32 preferably in an upper area 34 of the liquor tank 12. Conduit 32 acts as a circulation air conduit and is suitably connected to the suction-pressure blower 36. The circulation path following suction-pressure blower 36 is comprised of air circulation conduit 38 which extends between blower 36 and one side of an air channel 40, constructed with a relatively large surface area extending around radiation or heating plate 22. Thus, the circulation path drying air that follows will be from within inside drum 14 out through the perforations within the inside drum 14 to the space defined between liquor tank 12 and inside drum 14, where it is in contact with the film of cooling water formed on the inside surface of liquor tank 12. Thereafter, the air flows out of that space through apertures 24 and 26 in the rear wall of liquor tank 12, through conduit 32 and blower 36. The blower 36 then forces the air through air channel 40 past the heating plate 22 and thence through distributor pipe 42 back to the interior of inside drum 14.

As a result of that path, the lost heat yielded by the radiation plate 22 can be utilized for heating the dry air being returned to drum 14. The air channel 40 is constructed with as large a surface as possible with a relatively low height across the entire bulge 18 of the lower tank 12 so that as much heating as is possible will occur. The circulating air is again introduced into the inside drum 14 from the air channel 40 via a distributor pipe 42 connected between the opposite side of the air channel 40 and the inside of inside drum 14 as shown in FIG. 1. The circulation of air flowing through the air channel 40 absorbs the portion of the processing heat of the radiator 20 which would otherwise be lost, as a result of which the circulating air becomes more capable of absorbing steam.

Cooling water is continuously fed on both sides of liquor tank 12 by way of a cooling water system comprised of a main cold water supply conduit 44, control valve 46 and separate supply lines 48 and 50 connected, respectively, to opposite sides of liquor tank 12. The cooling water is distributed so as to be finely dispersed on the inside surface of liquor tank 12 and supply lines 48 and 50 are each connected to liquor tank 12 preferably at about midway between the top and bottom of liquor tank 12 or slightly above that midway point as is best shown in FIG. 1. Since the cooling water is distributed in a finely dispersed manner and in a continuous fashion the inside walls of liquir tank 12 are wetted substantially evenly by the cooling water in an essentially continuous film of water. Furthermore, the forced conduction of the air to the apertures 24 and 26 aids in forming that film and causes the majority of slubs or accumulations of lint which may be carried along in the stream of circulating air exiting through the perforations in the walls of inside drum 14, to be seized or collected by the film of cooling water. Thus, the slubs and lint will be washed away toward the drainage system 16, so that they are pumped away together with the cooling water by pump 52.

In order to prevent any heat in the area of the radiator 20 and of the air channel 40 to be lost, the outside of the air channel 40 is coated preferably with a heat insulating layer 54.

The constructural design of the drum washer and drying arrangement, according to FIG. 1, has the advantage on the one hand, that the directly heated inside drum can transmit the stored heat directly to the wet laundry laying against the wall of the inside drum 14. When laundry drops down in the rotating inside drum 14, the heated laundry is mixed well with the warm circulating air fed in through distributor pipe 42, so that the circulating air being resupplied to the drum 14 can be recharged with water vapor up to the saturation point. The water vapor (steam) escapes through the holes or perforations in the inside jacket of the inside drum 14 primarily the perforations in the upper portion of drum 14 so that by drawing-off circulating air in the lower area of the rear side of the liquor tank 12, air circulation is forced past condensation surfaces 56 and 58 thereby obtaining a maximum cooling and so as to produce a maximum amount of condensation.

With such a structure for a combined drum washer and drying arrangement, the time required for drying laundry can be shortened considerably whereby drying times can be achieved which are similar to drying times for dryers-only.

Figure 2:
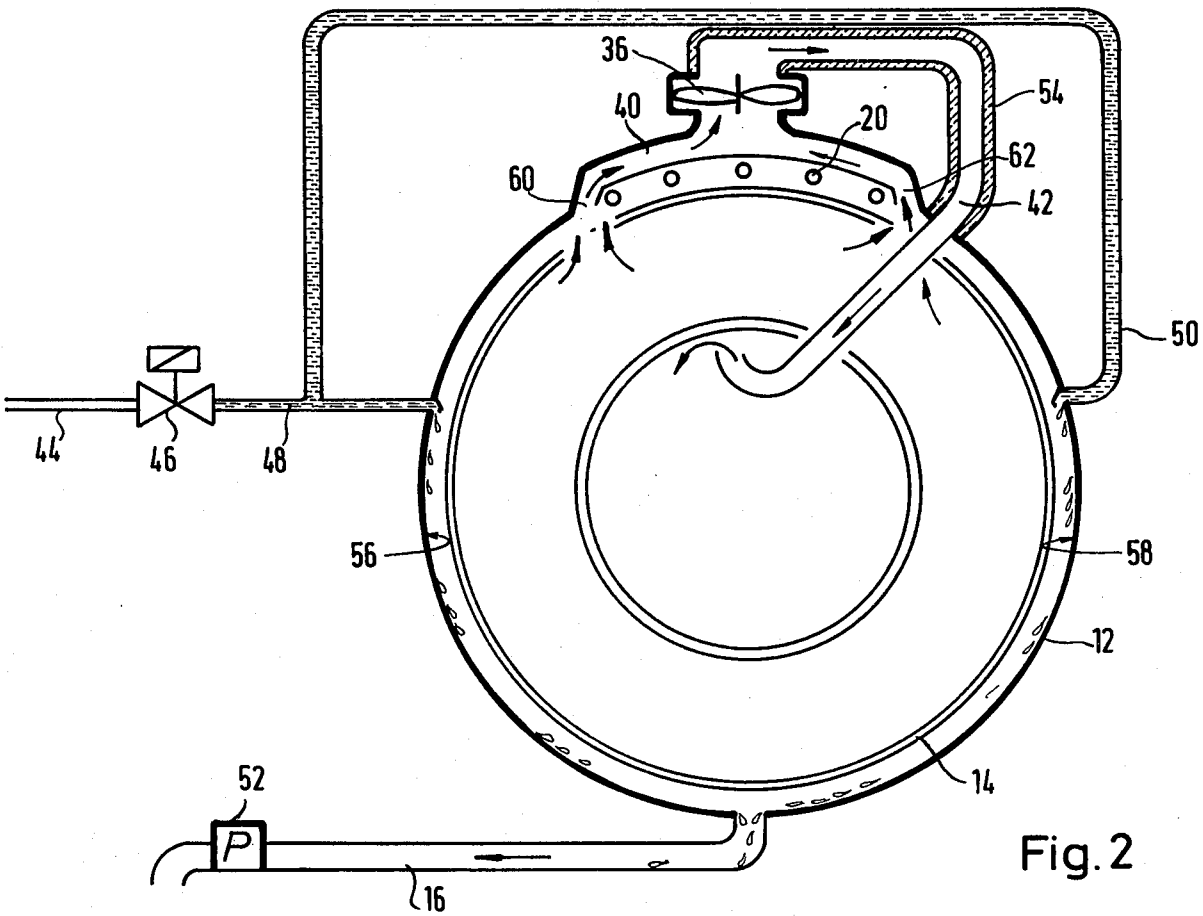
FIG. 2 is a schematic fragmentary presentation of a further development of the circulating air system for a drum washer and drying arrangement according to FIG. 1 in which the front outer housing and charging door has been omitted for clarity.

FIG. 2 shows a second embodiment of the combined drum washer and dryer, with which improved results can also be achieved. This second embodiment differs in that air circulation created by the rotation of the inside drum 14 which forces air through the perforated wall thereof, is guided past the condensation surfaces 56 and 58 and is drawn off on both sides of the radiation plate through suction apertures 60 and 62 and thereafter through air channel 40 and radiation or heating plate 22. Subsequent to yielding moisture through condensation while flowing past the condensation surfaces 56 and 58, the circulating air is heated and returned to inside drum 14 due to the action of suction-pressure blower 36.

Figure 3:
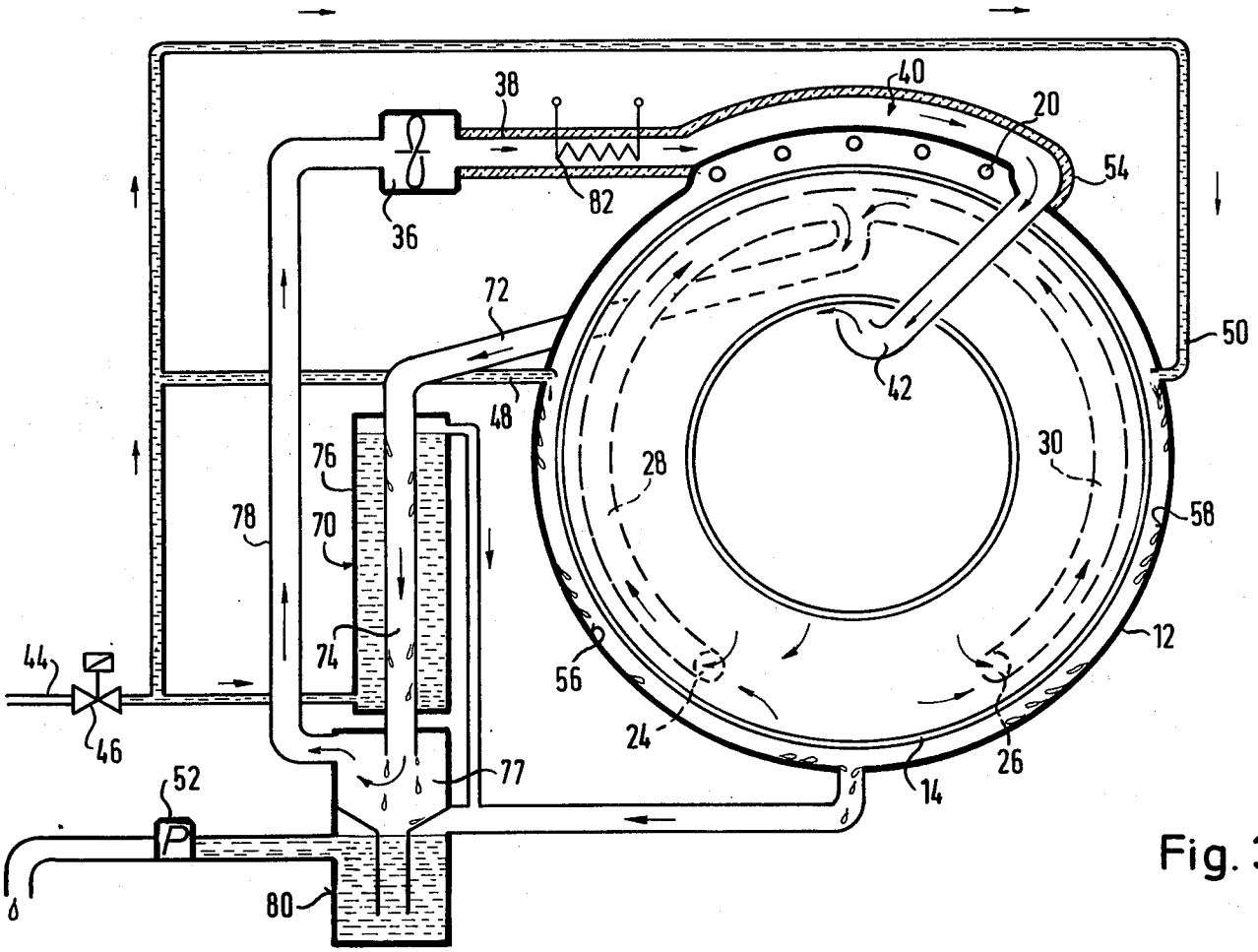
FIG. 3 is a schematic fragmentary presentation of another modified embodiment of the drum washer and drying arrangement as shown in FIG. 1 with a circulation air system which is guided via an additional, condensation and water separation arrangement in which the front outer housing and charging door has been omitted for clarity.

FIG. 3 shows another embodiment of the present invention wherein the liquor tank 12 is constructed in a similar fashion to that shown in FIG. 1. Apertures 24 and 26 continue to be disposed in the lower area of the rear wall of liquor tank 12 for drawing-off of circulating air at that low area and likewise the radiation or heating process in which heater 20 heats up the moist laundry. In addition, the cool water supply and the condensation process together with the discharge of the cooling and condensation water from liquor tank 12 is the same as described for FIG. 1. Further, the passage of the circulating air through air channel 40 by way of the radiator 20 and distributor pipe 42 back into the interior of the inside drum 14 is also as was described with regard to the embodiment shown in FIG. 1.

In the closed circulating-air circuit, however, another condensation and water separation arrangement, generally indicated at 70, has been inserted. Run off pipes 28 and 30 are shown as being connected to a conduit 72 which is connected between the liquor tank 12 and the suction-pressure blower 36 with the added condensation and water separation arrangement 70 being positioned therein. The condensation arrangement 70 consists of coaxial pipe lines 74 and 76 whereby the circulating air is conducted through the inside pipe 74 and the cooling water is conducted in counter current through the outside pipe 76. The inside pipe 74, which is an extension of conduit 72, terminates at a water separation arrangement indicated at 77 from which the circulating air is drawn off laterally through conduit 78 by suction-pressure blower 36 so that the condensate precipitating in the inside pipeline can drip down and be discharged by way of a siphon 80 and be pumped away by pump 52. As a result of this additional condensation and separation of water, the temperature of the circulating air can be further cooled so that an additional amount of moisture can be removed from the air by way of further condensation. This contributes quite considerably to the shortening of the drying time since the relatively dryer air can absorb additional amounts of moisture. Experiments show that such drying times can be reduced up to 70% as compared to the otherwise required drying time in case of combined drum washer and drying arrangements. Despite provision of an additional condensation arrangement as at 70, the consumption of cool water can also be considerably decreased. With the present invention heat energy which cannot usually be fed to the laundry and would otherwise be lost is used to heat the circulating drying air, prior to the return of that air to inside drum 14. Through this approach, the heating performance is improved about 20% over the usual drying time for dryers-only.

A further shortening of the drying period could be achieved by positioning an additional heating element 82 within air circulation conduit 38 as indicated in FIG. 3.

Figure 4:
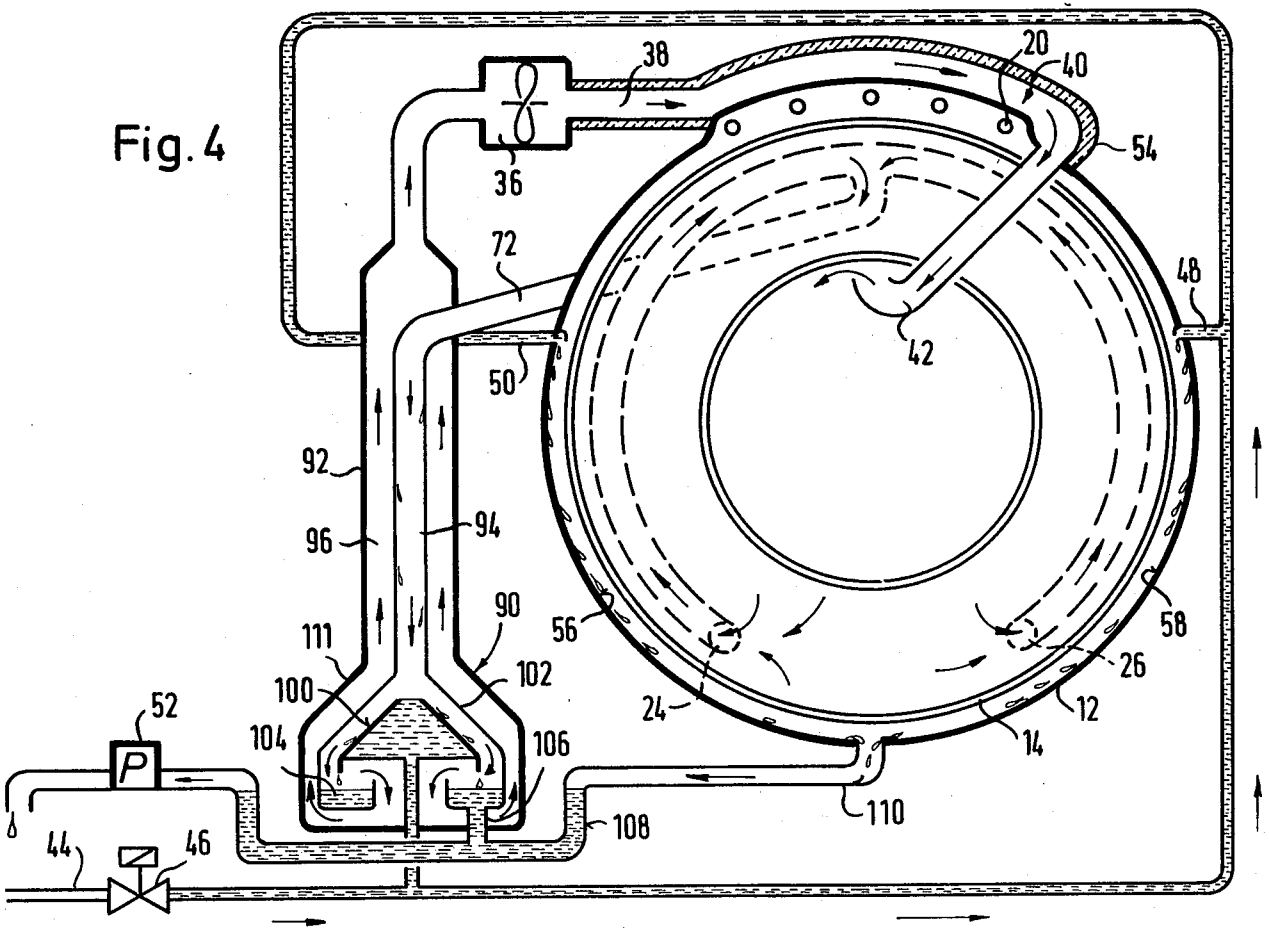
FIG. 4 is a schematic fragmentary presentation of still a further development of the drum washer and drying arrangement shown in FIG. 1 with an additional condensation and water separation arrangement as well as with a heat exchanger for further utilization of processing heat in which the front outer housing and charging door has been omitted for clarity.

FIG. 4 shows still another embodiment of the drum washer and drying arrangement according to the present invention. A modified condensation and water separation arrangement is combined with a heat exchanger 92 and is generally indicated at 90. Heat exchanger 92 preferably consists of coaxially guided pipes 94 and 96 whereby the inside pipe 94 conducts the circulating air coming from the liquor tank and the outside pipe 96 conducts the circulating air discharged to the suction-pressure blower 36. It has been found that the temperature of the air leaving liquor tank 12, through conduit 72 is about 100° C, whereas circulating air is cooled to about 80° C and less upon leaving the condensation arrangement 90. Thus circulating air conducted through outside pipe 96 to suction-pressure blower 36 has already been preheated in the heat exchanger 92 thereby effectively utilizing the processing heat of air exiting from liquor tank 12. This preheated air is heated up further in the air channel 40 as a rule to about 120° C, prior to being returned to the inside drum 14.

The further condensation and water separation arrangement 90 of the embodiment shown in FIG. 4 is comprised of a pyramid-like inside condensing unit 100, through which cooling water flows, and a pyramid-like outer structure 102 which surrounds and is spaced a slight distance from the pyramid-like structure 100. The circulating air fed from inside pipe 94 of the heat exchanger 92 flows in the space defined by structures 100 and 102 where it is cooled so that condensed water is formed on inside condensing unit 100. The outer structure 102 is provided with a collecting cup 104 along its lower edge and collecting cup 104 is positioned so as to extend inwardly beneath inside condensing unit 100. Thus, when the condensed water formed on the surface of inside condensing unit 100 flows down that pyramid-like surface it will be collected by cup 104. A drain line 106 connects collecting cup 104 with a siphon 108 positioned in the drain line 110 exiting drum liquor tank 12. Thus condensate collected in collecting cup 104 and the siphon 108 positioned in drain line 110 can be discharged together with the condensate from the liquor tank 12 by pump 52. The circulating air is fed in by way of inside line 94 and conducted like a labyrinth around collecting cup 104 and between outside structure 102 and an outer housing 111 to the outside pipe 96 of the heat exchanger 92.

The embodiment shown in FIG. 4 is particularly effective since a great difference in temperature can be produced by additional intensive condensation. However, the creation of this large temperature difference does not require any additional heating devices since the additional waste heat from the withdrawn air is used in the heat exchanger 92 to preheat air circulated through heat exchanger 92 toward blower 36.

Figure 5:
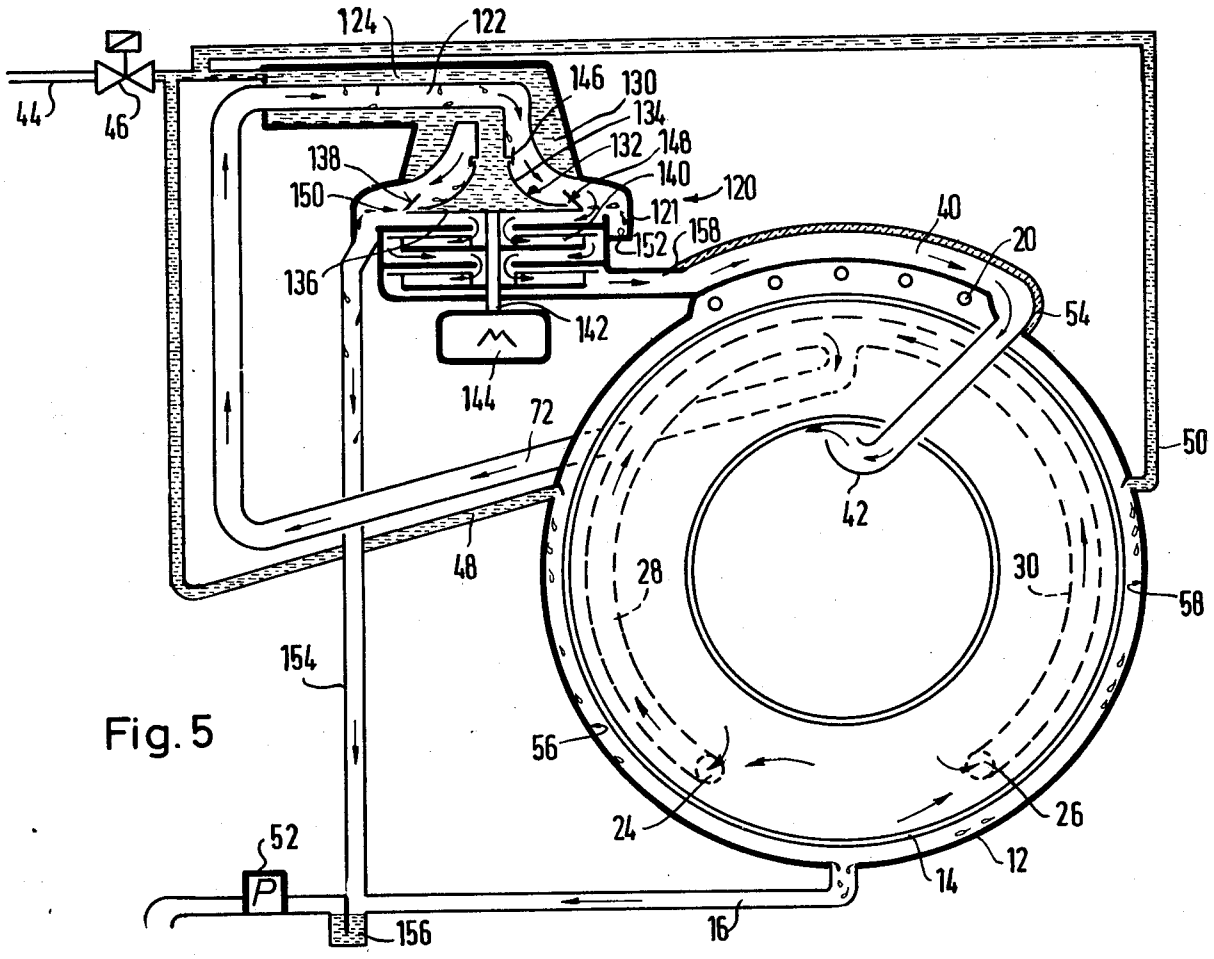
FIG. 5 is a schematic fragmentary presentation of another modified embodiment of the drum washer and drying arrangement shown in FIG. 1 with an additional condensation and water separation arrangement in the closed air circulation system in which the front outer housing and charging door has been omitted for clarity.

This is true also for another embodiment of the present invention as shown in FIG. 5. In this embodiment the condensation and water separation arrangement is further modified and is indicated generally at 120. The course of the cooling water to the liquor tank 12 acting as condenser and the radiation process for heating of the laundry, as well as the heating of the supplied air in the air channel 40 above the radiator 20 and the drawing-off of the circulating air from the liquor tank 12, take place in the same manner as described on the basis of FIG. 1. The suction line 72 leading away from the liquor tank 12 is fed to a modified condensation arrangement 120, which is comprised of an outer housing 121 and a coaxial system of pipes through which cooling water flows in the outside pipe 124 and which carries the circulating air in the inside pipe 122. The condensation arrangement 120 passes over directly into a water separator 130 which comprises a rotatable centrifugal disc 132 through which cooling water flows. The centrifugal disc 132 is a hollow body having an outer jacket 134 expanding in the shape of an inverted funnel, with its largest diameter associated with bottom disc 136. The peripheral edge of bottom disc 136 is turned upward around the lower periphery of outer jacket 134 so that a groove 138 is developed in which the condensate flowing in from the further condensation arrangement 120 and the condensate separating automatically on the centrifugal disc 132 can collect. The centrifugal disc 132 is connected coaxially with condenser 140 on drive shaft 142 of motor 144. The cooling water inlet to the inside cooled centrifugal disc 132 takes place by way of a rotationally movable gasket 146 positioned between the outside pipe 124 of condenser 120 and the centrifugal disc 132. The cooling water penetrating the centrifugal disc 132 flows out through small apertures 148 between the lower edge of the outer jacket 134 and the bottom disc 136 and is collected together with the condensate in groove 138. The groove 138 has apertures or bores 150 and while in particular one or two diametrically opposite bores are preferred, other arrangements should also be considered as being contemplated. Water collected in groove 138 emerges through bores 150 in the form of jets because of the high rpm of the centrifugal disc 132, and strikes the opposite wall of outer housing 121 surrounding the centrifugal disc 132. A collection channel 152 is formed within the bottom portion of outer housing 121 and in turn is connected to the drain system 16 by a drain line 154 and a siphon 156. Preferably, the wall of housing 121 is developed such that the emerging water deviating from the illustration strikes the housing wall at an obtuse or flat angle and is deflected downward and atomization of the water in this area should be avoided.

The circulation air is guided from the inner pipe 122 around the centrifugal disc 132 and is aspirated in the middle area of the bottom disc 136 by the condenser 140. Condenser 140 is a conventional multi-compartmented structure and conducts condensed circulation air via the air supply line 158 to the air channel 40 in which the circulating air is heated by waste heat from radiator 20.

Resistance of air circulation within the system is primarily overcome due to the presence of condenser 140 which acts as a suction-pressure blower, so that a perfect circulation of the air is assured.

The coaxial pipes 122 and 124 can be constructed in the form of a rigid inside line with a hose pushed over it as an outside line. Because of the air or water pressure, the hose serving as an outside line is filled up on all sides. On the basis of this development, it will be possible to accommodate the coaxial lines inside the housing of the drum washer and drying arrangement at a favorable place and also in a bent or curved form.

The use of the centrifugal disc 132 in the water separator has the advantage that the liquid precipitated by the condensation can be eliminated completely from the current of air, which contributes to the increase or effectiveness of the device. By employing the centrifugal disc 132 elimination of the condensed water from the stream of air is more readily assured since the drops of water are flung with sufficiently high pressure in the form of jets through the stream of air, so that the stream of air cannot entrain any water. Two apertures 150 in the groove 138 have proved to be best, and by placing the apertures opposite one another, balancing of the centrifugal disc becomes unnecessary. Since the flow of circulating air in the area of the centrifugal disc 132 is being expanded in cross section, the circulating air becomes less turbulent and because of the low temperature, absorption of any new moisture is unlikely.

Thus, in drum washer and drying arrangement constructed according to the present invention described herein by elimination of more than 37 gr/minute in case of a washing machine of traditional size, the drying time and the cooling water consumption could be reduced by more than 75%, along with a reduction of more than 10% in the energy consumed during heating. Thus, advantageous results for a combined drum washer and drying arrangement equal to apparatus designed only for drying purposes can be achieved with the disclosed drum washer and drying arrangement which results could not be achieved heretofore.

Figure 6:
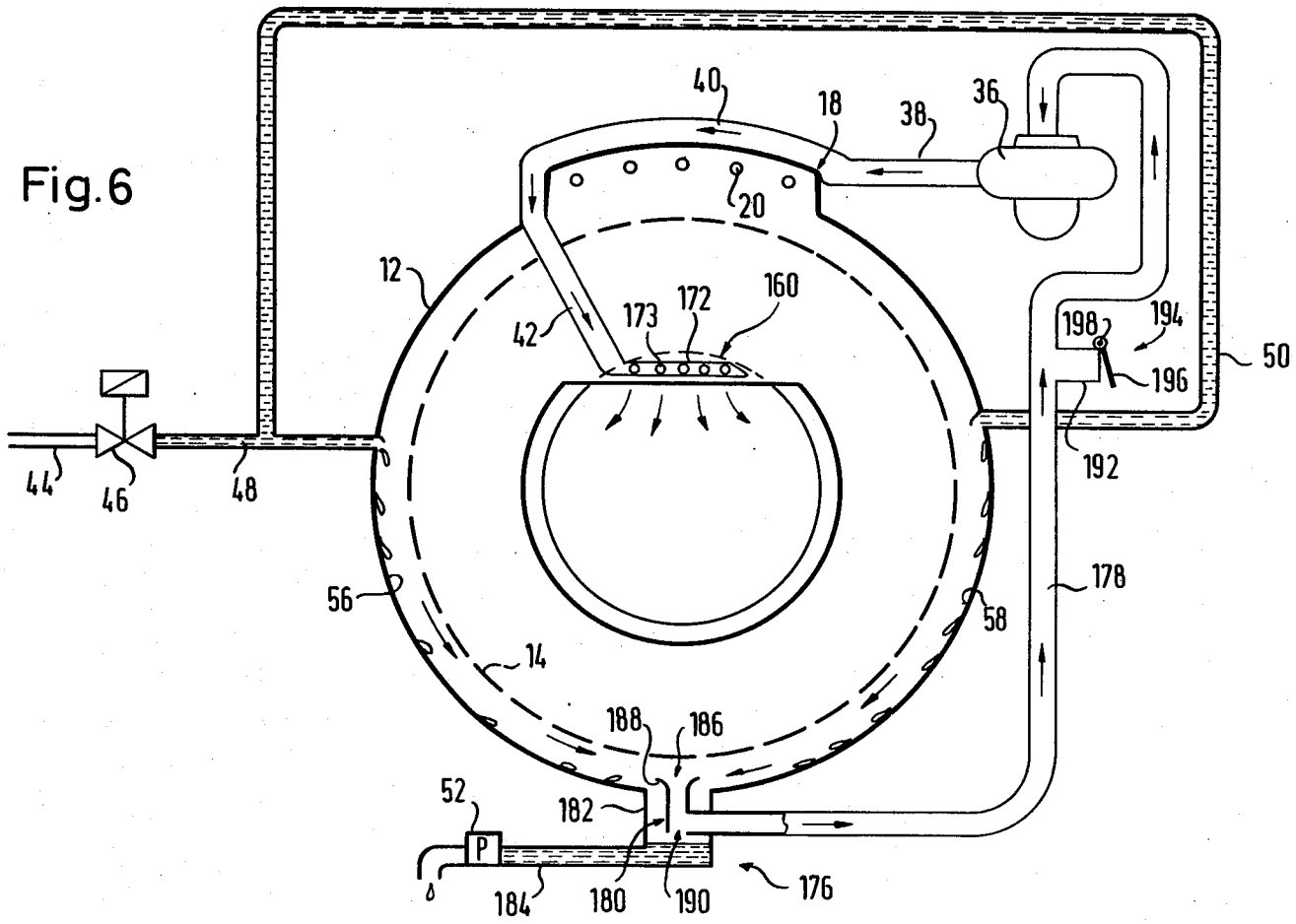
FIG. 6 is a schematic fragmentary presentation of a further modified embodiment of the drum washer and dryer combination employing a common air return conduit and overflow pipe in which the front outer housing and charging door has been omitted for clarity.
Figure 7:
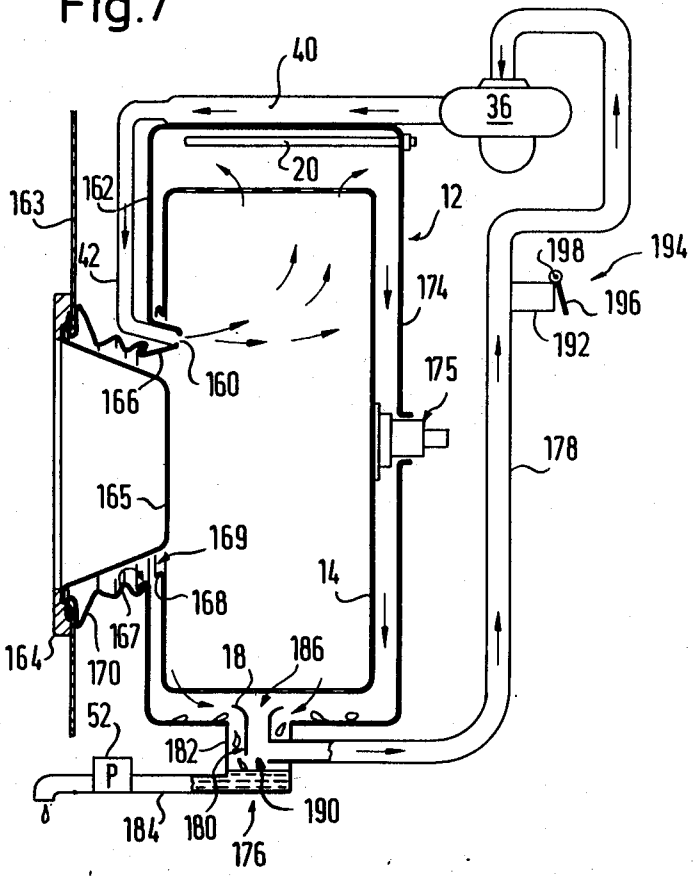
FIG. 7 is a schematic cross-sectional view of the combination washer and dryer embodiment shown in FIG. 6 in which the front outer housing and charging door has been omitted for clarity.

Turning now to FIGS. 6 and 7, an additional embodiment of the present invention is set forth.

Air flowing from the blower 36 passes through the air channel 40 and thence through distributor pipe 42 which is now provided at its outlet end with nozzle referred to generally at 160 which is mounted in any suitable way to the front wall 162 of liquor tank 12 and positioned in a particular way as will be described hereinafter.

The combination washer/dryer would normally be enclosed in an attractive outer housing. In FIG. 7, a fragmentary portion of the front portion of that outer housing is shown at 163. The front portion 163 of the outer housing serves to support the charging door 164, of conventional construction, and which includes an inspection glass as shown at 165.

As indicated above, the front wall 162 of liquor tank 12 is provided with a folded portion or rim 166 which serves to define the loading opening 167 within liquor tank 12. Likewise, a portion of the forward wall 168 of inside drum 14 which is folded which also serves to form a rim 169 defining the loading opening 170 in the inside drum 14, with openings 167 and 170 being substantially in axial alignment.

A bellows or folded sealing hose 171 extends between and is secured by any convenient means to the front portion 163 of the outer housing and the folded portion 166 of front wall 162 of liquor tank 12. Thus, the bellows 171 serves to connect the rim of loading opening 167 with the opening formed in the front portion 163 of the outer housing which is closed by charging door 164.

As shown in FIG. 7, the distributor pipe 42 which terminates with nozzle 160 is positioned so that the nozzle 160 is mounted adjacent to the folded portion 166 of front wall 162 and above loading opening 167. Also it should be noted that nozzle 160 extends through the front wall 162 of tank 12 so as to be able to discharge heated air into the interior of inside drum 14. This is possible since the folded portion or rim 166 extends beneath and interiorly of rim 169 at least in the upper portions of loading openings 167 and 170.

By mounting nozzle 160 in such fashion the distributor pipe 42 and nozzle 160 are positioned or located so as to be above the bellows or folded sealing hose 171. In particular, nozzle 160 is integrated into the front wall 162 of liquor tank 12 just above the point where bellows 170 is attached to rim 166.

As indicated above, the open or discharge end of nozzle 160 terminates within insides drum 14. Preferably, nozzle 160 is comprised of an elongated pipe 172 secured to the outlet end of distributor pipe 42 and is provided with a plurality of apertures 173 which are spaced apart a predetermined distance so as to extend along the length of elongated pipe 172. Preferably, apertures 173 are circular holes but they could equally well be elongated slots. What is important is that the air discharged from nozzle 160 be in a fan-like pattern over a circular section so that the circulating air is blown into the inside drum 14 sweeping the upper surface of laundry like a fan. This sweeping action created in the circulating air creates turbulence across the upper surface of the laundry and since the incoming air has a relatively high temperature, the turbulence together with the high temperatures serve to charge the air almost 100% with moisture. Withdrawal of moisture can also be further increased if the volume of the incoming air is at a predetermined ratio to the temperature and the condensation capacity of the dryer so that condensation can be substantially complete. In this way the quantity of the flow of circulating air can be reduced without affecting the efficiency of the dryer.

The inside drum 14 is also perforated and is rotatably mounted within liquor tank 12 specifically to the rear wall 174 of tank 12 by conventional rotary mounting means shown generally at 175.

FIGS. 6 and 7 also show a modified drainage system, referred to generally at 176, which is now located in the lower part of liquor tank 12. Pump 52 and a sump are still employed but an overflow pipe 178 is now shown which has an inlet 180 positioned within an enlarged vertical portion 182 of the drain conduit 184 which depends from the bottom of liquor tank 12 and extends between drain conduit 184 and the bottom of liquor tank 12. As shown, a short column of water will be allowed to occupy the lower part of the enlarged portion 182 so as to form a sump, with inlet 180 of the overflow pipe 178 being positioned thereabove a sufficient distance so that during drying the circlating air being sucked off by blower 36 will not also suck water from the sump.

The mouth of the inlet 180 is curved upwardly about 90° with the upwardly facing end referred to generally at 186 being flared as shown at 188 so as to be shaped substantially like a funnel. The bend at the bottom of inlet 180 is provided with an opening, referred to generally at 190, so that any water remaining in overflow pipe 178 can easily drain into the sump formed in drainage conduit 184.

The upwardly facing end 186 of inlet 180 which is funnel-shaped is preferably positioned within the lower portion of liquor tank 12 and spaced just above the opening leading into the enlarged portion 182. Also, inlet 180 is preferably centrally located within enlarged portion 182 but it is only essential that inlet 180 be spaced from the sides of enlarged portion 182 so that condensed water forming the film on and flowing down the interior walls of liquor tank 12 will not flow into inlet 180 but will rather flow around inlet 180 thus allowing only circulating air to pass into overflow pipe 178.

By locating the air inlet at the lowermost position possible, the condensation surfaces 56 and 58 are enlarged to their optimum size.

Overflow pipe 178 is provided with an extension portion 192 which serves to form an overflow outlet. A valve 194 is provided so as to cover the overflow outlet and as shown, for example, could be a simple flap valve comprised of a valve flap 196 pivotally secured to overflow pipe extension 192 as by hinge 198. Valve 194 acts in such a way that during the drying operation when blower 36 is operating, valve flap 196 will automatically close due to the suction or vacuum created within overflow pipe 178 by blower 36. However, when blower 36 is not operating and water somehow unexpectedly leaks into liquor tank 12, causing an overflow situation, excess water will be permitted to flow off or overflow through the outlet formed by extension portion 192 when water reaches a level within liquor tank 12 equal to the level of extension portion 192.

Figure 8:
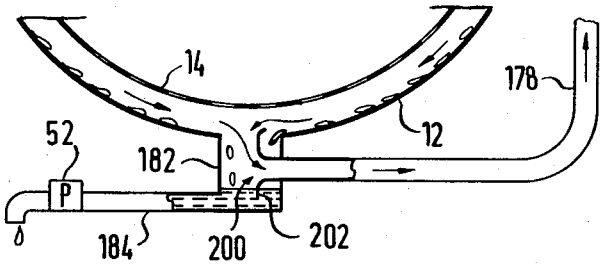
FIG. 8 is a schematic view of a modified inlet for the overflow and air return conduit arrangement shown in FIG. 6 in which the front outer housing and charging door has been omitted for clarity.

FIG. 8 shows a modified inlet 200 for overflow pipe 178. The modified inlet 200 of overflow pipe 178 again extends into the enlarged portion 182 of the drainage conduit 184 and is provided with a flared funnel-shaped outer lip 202. Inlet 200 is now positioned so that the funnel-shaped outer lip 202 positioned vertically within enlarged portion 182 and also spaced vertically above water forming the sump within drainage conduit 184.

The overflow pipe 178 is shown in FIGS. 6 and 7 as being connected directly to blower 36 so that air being drawn off and from which moisture has been condensed can be recirculated again and again within a relatively closed system. It should be well understood, however, that the air drawn off could be discharged directly to the atmosphere and not recirculated through blower 36. In that instance blower 36 would be provided with an inlet through which fresh air could be brought into the drying system.

As has already been mentioned, nozzle 160 is positioned just above the upper edge of rim 166 and can project into the inside of the inside drum 14. In those cases where a normal charge of laundry is placed within inside drum 14, the latter is filled with laundry to a point which is just below the level of the outlet openings 173 of nozzle 160. Nozzle 160 can also be directed slightly downward if so desired so that air emerging therefrom sweeps quite closely over ythe surface of the laundry so as to thereby create a turbulence. At the same time the pressure of the emerging circulating air is adjusted such that a sufficient turbulence and thus an optimum loading with moisture is guaranteed. As a result of the mechanical effect during the turbulence, a slight vacuum develops above the laundry which contributes to the possiblity of loading the fed-in quantity of circulating air almost completely with moisture.

Careful synchronizing of the temperature of the incoming circulating air and especially of the quantity of air and of the rate of flow, at which the latter flows in, is of essential importance for achieving an optimum of gas exchange during charging of the circulating air with moisture. If the supply of steam in relation to the fed-in quantity of circulating air is too small, there will, then, be a great deal of excess unused energy in the condenser. Since the circulating air is not sufficiently saturated with moisture it will at first only lose heat energy, before the condensation begins. It thus is apparent, that one can get along with a considerably smaller quantity of air than was customary hitherto. Since less air has to be circulated, blower 36 can be operated with a minimum noise load. For an optimum profitability, the ratio of pressure of the circulating air forced into the inside drum 14, the outlet cross section of the nozzle 160 and the time of the exchange of the volume of air in the inside drum must be at an optimum. If the circulating air is exchanged too fast, then the power drain on the condenser will be unnecesarily high and will not materially contribute to the desired drying process.

Whenever in the interest of optimum results, a smaller quantity of air is used the film of water on the condensation surfaces 56 and 58, particularly in case of running off into the drainage system 176, is not torn, so that not even tiny droplets of water are entrained by the air sucked into the overflow pipe 178. A further advantage, as has already been mentioned, is that the circulating air brought to the condenser is almost 100% saturated with steam and the condensation thus starts immediately. Furthermore, even in case of a smaller quantity of air and a slower circulation, a lower motor performance is required, and in this way energy is saved again.

As a result of the combination of the measures of the invention, namely sucking off of circulating air free of water in the area of the drainage system 180, with the use of the overflow pipe 178 for the conduction of air in connection with the valve 194 as well as with an optimal amount of circulating air through nozzle 160, the degree of effectiveness of the drum washer and drying can be improved in an unforeseen manner whereby one cannot only achieve a lower energy consumption and a shorter operating time for the drying process, but the blower 36 can be operated at an essentially lower noise load.

As an example of one embodiment of the invention a hole-type nozzle spread out over a circular sector can be used having an exit cross section of about 0.0175 $dcm^2$. By using a pressure of 70 mm/Ws in front of the nozzle outlet, the emerging speed for the circulating air can be in the order of magnitude of 334 dcm/sec, so that an air volume of about 22 liters corresponding to the space above the laundry in the inside drum 14 can be exchanged within 3.76 seconds. That means, that in case of an operating time of 30 minutes about $10.5m^3$, or in case of an operating time of 40 minutes about $14m^3$ of air would be circulated. Whenever this is compared with the fact that standard dryers-only circulate about $90m^3$ or $100m^3$ or air in the same time, then it is quite apparent that nuisance caused by noise is considerably less as compared to known installations.

As a result of the fact that the heated circulating air is introduced through the front wall of liquor tank 12, it will be possible to heat the circulating air to a considerably higher temperature, for example, between 170° C and 200° C with the desired temperature being chosen depending, of course, upon the speed of flow and the quantity of air. By a variation of these values, depending on the structure and size of the combined drum washer and dryer, the circulating air can be loaded optimally with moisture and that moisture can thereafter be carried off.

Whenever, with progressive drying, the laundry in the inside drum 14 is loosened up, the air, blown in by way of nozzle 160 sweeps through the loosely lying laundry in the upper area of the inside drum 14, as a result of which the mechanical turbulence as well as the loading with moisture will be improved further. As a result of the measures of the present invention, the drying process can be optimized so extensively, that optimum conditions prevail practically during the entire operating time necessary for the drying of the laundry. These optimal conditions can be recognized from temperature measurements at different points of the system during the drying operation. After switching on the drying process, the temperature of the laundry rises within less than 10 minutes from about 20° C to about 60 to 70° C and maintains this temperature during the entire drying process. At the same time, the temperature of the fed-in circulating air on the nozzle is at about 160° C to about 200° C and reaches the condenser surfaces in its saturated state at from about 100° C to 110° C. After the condensation process, the circulating air during the sucking off of it in the drainage system, has been cooled down to about 50° C. These temperature figures occurred in case of an optimal operation with the precedingly stated values for the exit speed of the circulating air on the nozzle and the volume of air. However let us point out, that because of the dependence of the individual influencing factors, others too but the conditions stated, can lead to an optimum operation.

It will now be clear that there is provided a device which accomplishes the objective heretofore set forth. While the invention has been disclosed in preferred forms, it is to be understood that the specific embodiments described and illustrated herein are not to be considered in a limited sense as there may be other forms or modifications of the present invention which should also be construed to come within the scope of the appended claims.

What is claimed is:

1. A device for both washing and drying laundry comprising: outer container means for enclosing the washing and drying compartment; inner container means forming the washing and drying chamber and for holding the laundry being treated, said inner container being rotatably mounted within and spaced from said outer container means; air circulation means for forming an air circulation path within said device and for circulating air through that circulation path such that air is provided to and withdrawn from said inner container; heating means adjacent the air circulation path for heating air being circulated in the air circulation means, said heating means positioned so as to heat air prior to the circulation of such air into said inner container means; cooling means for cooling air within said air circulation means, said cooling means positioned to cool air as the air is withdrawn from said inner container means; said cooling means including a first condensation means located in the space defined between said inner and outer container means, cooling medium supply means for supplying a cooling medium to said first condensation means; drain means for draining away the cooling medium and the condensation said drain means including the inlet to said air circulation means; said air circulation means including means for directing air withdrawn from said inner container means through said first condensation means and thereafter out of said outer container through said drain means and into the inlet of said air circulation means.

2. A combination washer-dryer device as in claim 1 wherein said first condensing means includes: inlet pipes attached to opposite sides of said outer container means at least midway between the top and bottom of said outer container means and control means for controlling the flow of a cooling medium through said inlet pipes so as to form a substantially continuous film on the interior surface of said outer container means; and wherein said air circulation means further includes a plurality of perforations within said inner container means and at least one outlet in said outer container means so that air withdrawn from said inner container means through said perforations will pass to said at least one outlet and thereby pass through said first condensation means and in contact with the cooling medium therein.

3. A combination washer-dryer as in claim 2 wherein said air circulation means further includes blower means for circulating air through said air circulation means, inlet means for directing circulating air into said inner container means, first air conduit means extending between said blower means and said inlet means, and second air conduit means extending between said at least one outlet and said blower means.

4. A combination washer-dryer as in claim 3 wherein said at least one outlet is positioned within said drain means.

5. A combination washer-dryer as in claim 1 further including a second heating means adjacent the air circulation path for heating circulating air to a higher temperature, said second heating means being positioned downstream from the other said heating means.

6. A device for both washing and drying laundry comprising: outer container means for enclosing the washing and drying compartment said outer container means including a loading opening; inner container means forming the washing and drying chamber and for holding the laudry being treated said inner container means including perforated sidewalls, said inner container being rotatably mounted within and spaced from said outer container means; air circulation means for forming an air circulation path within said device and for circulating air through that circulation path such that air is provided to and withdrawn from said inner container; heating means adjacent the air circulation path for heating air being circulated in the air circulation means, said heating means positioned so as to heat air prior to the circulation of such air into said inner container means; cooling means for cooling air within said air circulation means, said cooling means positioned to cool air as the air is withdrawn from said inner container means; said cooling means including a first condensation means located in the space defined between said inner and outer container means, cooling medium supply means for supplying a cooling medium to said first condensation means; said air circulation means including means for directing air withdrawn from said inner container means through said first condensation means; and drain means for draining away the cooling medium and the condensation and for providing the exit for air from said outer container means, wherein said air circulation means further includes inlet means for directing heated circulating air into said inner container means, said inlet means comprising an elongated nozzle positioned adjacent said loading opening, said elongated nozzle including means defining a plurality of spaced apart apertures extending along the length of said elongated nozzle through which the circulating air is forced, said nozzle being positioned so that air emerging from said apertures is directed towards the interior of said inner container means so that said air circulation means withdraws air through the perforated sidewalls of said inner container means, through said cooling means and said first condensation means and out of said outer container means through said drain means.

7. A combination washer-dryer as in claim 6 wherein said apertures are circular openings.

8. A combination washer-dryer as in claim 6 wherein said apertures are slots.

9. A combination washer-dryer as in claim 6 wherein said apertures are positioned on said elongated nozzle so that the direction of flow of air emerging therefrom is inclined slightly downward toward the upper surface of laundry within said inner container means.

10. A combination washer-dryer as claimed in claim 6 wherein said inlet means comprises an elongated nozzle, said elongated nozzle including means defining a plurality of apertures extending along the length of said elongated nozzle so as to form air passing through said elongated nozzle and said apertures into a fan-like pattern within said inner container means.

11. A combination washer-dryer as claimed in claim 6 wherein said inlet means comprises a nozzle provided with a plurality of outlets therein and having an outlet cross section running across a circular sector.

12. A device as in claim 6 wherein said drain means comprises a first conduit connected to and extending away from the bottom of said outer container means defining a drain path for the cooling medium and the condensation, a second conduit positioned internally within said first conduit for forming the inlet end of said air circulation means.

13. A device for both washing and drying laundry comprising: outer container means for enclosing the washing and drying compartment; inner container means forming the washing and drying chamber and for holding the laundry being treated, said inner container being rotatably mounted within and spaced from said outer container means; air circulation means for forming an air circulation path within said device and for circulating air through that circulation path such that air is provided to and withdrawn from said inner container; heating means adjacent the air circulation path for heating air being circulated in the air circulation means, said heating means positioned so as to heat air prior to the circulation of such air into said inner container means; cooling means for cooling air within said air circulation means, said cooling means positioned to cool air as the air is withdrawn from said inner container means; said cooling means including a first condensation means located in the space defined between said inner and outer container means, cooling medium supply means for supplying a cooling medium to said first condensation means, said air circulation means including means for directing air withdrawn from said inner container means through said first condensation means; and drain means for draining away the cooling medium and the condensation wherein said first condensing means includes inlet pipes attached to opposite sides of said outer container means at least midway between the top and bottom of said outer container means and control means for controlling the flow of a cooling medium through said inlet pipes so as to form a substantially continuous film on the interior surface of said outer container means; and wherein said air circulation means further includes a plurality of perforations within said inner container means and at least one outlet in said outer container means so that air withdrawn from said inner container means through said perforations will pass to said at least one outlet and thereby pass through said first condensation means and in contact with the cooling medium therein; said air circulation means further including blower means for circulating air through said air circulation means, inlet means for directing circulating air into said inner container means, first air conduit means extending between said blower means and said inlet means, and second air conduit means extending between said at least one outlet and said blower means wherein said at least one outlet is positioned within said drain means and wherein said blower means is positioned above the maximum desired liquid level within said outer container means, said second air conduit means including valve means positioned between said outlet and said blower means at the maximum desired liquid level within said outer container means for allowing excess liquid within said outer container means to overflow therefrom, thereby maintaining the desired liquid level therein, said valve means being automatically closeable when said blower means is circulating air within said air circulation means.

14. A combination washer-dryer as in claim 13 wherein that portion of said second conduit forming said at least one outlet has been widened in the shape of a funnel.

15. A combination washer-dryer as in claim 13 wherein said air circulation means includes blower means for withdrawing air from and returning air to said inner container means.

16. A combination washer-dryer as in claim 15 wherein said heater means is positioned downstream from said blower means so as to heat air emitted from said blower means.

17. A combination washer-dryer as in claim 15 wherein said cooling means includes second condensation means positioned in the air circulation path within said device and between said first condensation means and said blower means whereby the air withdrawn from said inner container means is also drawn through said second condensation means and cooled an additional amount thereby removing more moisture through additional condensation.

18. A combination washer-dryer as in claim 17 wherein said second condensation means is comprised of an inner housing connected to said air circulation means so that air withdrawn from said first condensation means passes therethrough, an outer housing coaxially aligned with at least a portion of said inner housing means for connecting said outer housing to said cooling medium supply means and said drain means so that cooling medium will flow therethrough and water separation means for collecting and discharging water condensed out of the air flowing through said second condensation means.

19. A combination washer-dryer as in claim 18 wherein said water separation means comprises a collection cup which forms the bottom of said outer housing said collection cup extending beneath at least a portion of said inner housing such that the air will initially flow between the inner and outer housing and thereafter in a labyrinth-fashion between said collecting cup and said inner housing.

20. A combination washer-dryer as in claim 18 wherein said water separation means comprises centrifugal disc means connected to at least a part of said outer housing so that the cooling medium flows therethrough for separating condensed water from the air and means for rotating said centrifugal disc means.

21. A combination washer-dryer as in claim 20 wherein said centrifugal disc means comprises a funnel shaped expanding jacket having an upper portion rotatably attached to said outer housing and a bottom portion, a disc member positioned beneath and spaced from the bottom portion of said jacket and attached to said rotating means, said disc member having an upturned outer edge portion extending in part around the bottom poriton of said jacket, said upturned portion of said disc member forming a collecting groove for collecting water condensed out of the air circulating through said second condensation means and cooling medium escaping from the space between said jacket and said disc member, said collecting groove having a plurality of apertures provided therearound so that as said disc member rotates condensed water and the cooling medium are forced outwardly through said plurality of apertures toward said outer housing and drain means attached to said outer housing for receiving and draining away the material discharged through said plurality of apertures in said collecting groove.

22. A combination washer-dryer as in claim 21 wherein the material is discharged from said plurality of apertures in said collecting groove in the form of jets and where said jets strike said outer housing at an obtuse angle directed toward said drain means.

23. A combination washer-dryer as in claim 17 wherein said second condensation means comprises an inner housing, means for circulating a cooling medium through said inner housing, an outer housing positioned at least in part around said inner housing said outer housing forming part of the air circulation means so that the air flow is directed by said outer housing around said inner housing, means for collecting and discharging water condesnsed out of the air flowing through said second condensation means said collecting means being attached to said outer housing.

24. A combination washer-dryer as in claim 17 wherein said air circulation means further includes heat exchanger means positioned between said second condensation means and said blower means for preheating air exiting said second condensation with the air exiting said first condensation means.

25. A combination washer-dryer as in claim 24 wherein said heat exchanger includes inside and outside tube members, said tube members being coaxially aligned, said inside tube being rigid and said outside tube comprising a flexible hose fitted over said rigid inside tube member.

26. A combination washer-dryer as in claim 13 wherein at least that portion of said air circulation means containing heated air is provided with an insulating covering.

27. A device for both washing and drying laundry comprising: outer container means for enclosing the washing and drying compartment; inner container means forming the washing and drying chamber and for holding the laundry being treated, said inner container being rotatably mounted within and spaced from said outer container means; air circulation means for forming an air circulation path within said device and for circulating air through that circulation path such that air is provided to and withdrawn from said inner container; heating means adjacent the air circulation path for heating air being circulated in the air circulation means, said heating means positioned so as to heat air prior to the circulation of such air within said air circulation means, said cooling means positioned to cool air as the air is withdrawn from said inner container means; said cooling means including a first condensation means located in the space defined between said inner and outer container means, cooling medium supply means for supplying a cooling medium to said first condensation means; said air circulation means including means for directing air withdrawn from said inner container means through said first condensation means, and drain means for draining away the cooling medium and the condensation wherein said first condensing means includes inlet pipes attached to opposite sides of said outer container means at least midway between the top and bottom of said outer container means and control means for controlling the flow of a cooling medium and through said inlet pipes so as to form a substantially continuous film on the interior surface of said outer container means, and wherein said air circulation means further includes a plurality of perforations within said inner container means and at least one outlet in said outer container means so that air withdrawn from said inner container means through said perforations will pass to said at least one outlet and thereby pass through said first condensation means and in contact with the cooling medium therein, said air circulation means further including blower means for circulating air through said air circulation means, inlet means for directing circulating air into said inner container means, first air conduit means extending between said blower means and said inlet means, and second air conduit means extending between said at least one outlet and said blower means wherein said at least one outlet is positioned within said drain means and wherein that portion of said second conduit forming said at least one outlet is curved upwardly within said drain means toward said inner container means, and is provided with a mouth widened in the shape of a funnel, said widened mouth extending above the level established by the bottom of said outer container means.

28. A combination washer-dryer as in claim 27 wherein the lowest portion of that portion of said second air conduit positioned within said drain means includes means defining a drain opening for allowing any liquid within said second air conduit to drain therefrom into said drain means.

29. A device for both washing and drying laundry comprising: outer container means for enclosing the washing and drying compartment; inner container means forming the washing and drying chamber and for holding the laundry being treated, said inner container being rotatably mounted within and spaced from said outer container means; air circulation means for forming an air circulation path within said device and for circulating air through that circulation path such that air is provided to and withdrawn from said inner container; heating means adjacent the air circulation path for heating air being circulated in the air circulation means, said heating means positioned so as to heat air prior to the circulation of such air into said inner container means; cooling means for cooling air within said air circulation means, said cooling means positioned to cool air as the air is withdrawn from said inner container means; said cooling means including a first condensation means located in the space defined between said inner and outer container means, cooling medium supply means for supplying a cooling medium to said first condensation means; said air circulation means including means for directing air withdrawn from said inner container means through said first condensation means; and drain means for draining away the cooling medium and the condensation wherein a portion of a top of said outer container means comprises a pressed-out pocket, said heating means being positioned within said pressed-out pocket whereby the interior surface of said pressed-out pocket serves as a radiation plate and wherein the exterior surface of said pressed-out pocket forms part of said air circulation means downstream from said blower means so that air passing thereover is heated.

30. A combination washer-dryer as in claim 29 wherein that portion of said air circulation means formed around said pressed-out pocket is in the form of a flat channel.

* * * * *